United States Patent [19]

Rouzies

[11] Patent Number: 4,899,269

[45] Date of Patent: Feb. 6, 1990

[54] SYSTEM FOR REGULATING THE OPERATING POINT OF A DIRECT CURRENT POWER SUPPLY

[75] Inventor: Christian Rouzies, Toulouse, France

[73] Assignee: Centre National D'Etudes Spatiales, Paris, France

[21] Appl. No.: 300,923

[22] Filed: Jan. 24, 1989

[30] Foreign Application Priority Data

Jan. 29, 1988 [FR] France ..... 88 01057
Jul. 18, 1988 [FR] France ..... 88 09682

[51] Int. Cl.[4] ..... G05F 1/67
[52] U.S. Cl. ..... 363/41; 323/906
[58] Field of Search ..... 323/283, 285, 906; 363/17, 41, 80, 98; 307/45, 46

[56] References Cited

U.S. PATENT DOCUMENTS

| | | | |
|---|---|---|---|
| 3,626,198 | 12/1971 | Boehringer | 323/906 X |
| 4,390,940 | 6/1983 | Corbefin et al. | 323/906 X |
| 4,404,472 | 9/1983 | Steigerwald | 323/906 X |
| 4,678,983 | 7/1987 | Rouzies | 323/906 X |
| 4,691,159 | 9/1987 | Ahrens et al. | 323/906 X |

FOREIGN PATENT DOCUMENTS

| | | |
|---|---|---|
| 2175653 | 10/1973 | France . |
| 2504605 | 10/1982 | France . |
| 0194514 | 8/1986 | Japan . |
| 0285519 | 10/1986 | Japan . |
| 0036317 | 2/1988 | Japan . |

*Primary Examiner*—Patrick R. Salce
*Assistant Examiner*—Kristine Peckman
*Attorney, Agent, or Firm*—Nixon & Vanderhye

[57] ABSTRACT

A system for regulating the operating point of a direct current power supply comprising a current generator system connected to a pulse width modulation converter includes a circuit for sampling and measuring the voltage and the current supplied by the current generator. A threshold detector circuit responding to stalling of the converter supplies a logic signal representing the stalled or non-stalled state of the converter relative to threshold values. A regulation loop includes a switching device for inverting the sign of the error signal so that the operating point can be moved towards the maximum power point on the output current-voltage characteristic of the current generator. The system is applicable to regulation of the electrical power supply circuits of spacecraft, space probes, satellites and the like.

14 Claims, 10 Drawing Sheets or

Key: $t_1$: solar generator I(V) characteristic cold and low illumination $t_1<t_2<t_3$
$t_2$: ——— intermediate conditions
$t_3$: ——— warmer and higher illumination

SYSTEM FOR REGULATING THE OPERATING POINT OF A DIRECT CURRENT POWER SUPPLY

BACKGROUND OF THE INVENTION

1. Field of the invention

The present invention relates to a system for regulating the operating point of a direct current power supply comprising a current generator system connected to a pulse width modulation converter.

2. Description of the prior art

Electrical power is usually supplied to an aircraft or spacecraft from current generators such as solar generators. Current generators have a substantially rectangular output current-voltage characteristic I(V), acting as a current source in the area (I) and a voltage source in the area (II) as shown in FIG. 1*a*. The output power-voltage chracteristic P(V) is substantially triangular, as shown in FIG. 1*b*.

These generators are normally associated with an electrical energy converter using pulse width modulation to deliver rectangular voltage pulses the width of which varies according to the power consumed by a load circuit. This type of converter is usually referred to as a "PWM" converter and is used in devices referred to as "BUCK", "BOOST" or "BUCK-BOOST" devices.

The input current-voltage characteristic I(V) of a converter of this kind supplying a load consuming constant power is in the shape of the positive part of an equilateral hyperbola as shown in FIG. 1*c* as these essentially reactive and highly efficient converters consume very little power.

Conventionally, the electronic regulation loop of these converters includes an error amplifier comparing the voltage to be regulated (the voltage supplied to the load) with a reference voltage, the amplified error signal being supplied to a comparator which modulates the width of the voltage pulses supplied by the converter by comparing the error signal with a signal generated by a sawtooth signal generator. An integrator is included at the output of the comparator to provide a null static error.

Depending on the direction in which the error signal is varying as a function of variation in the voltage to be regulated, a given converter has its operating point either in the current source area I or in the voltage source area II of the output current-voltage characteristic of the generator for a constant consumed power P, as shown in FIGS. 1*d* and 1*e*.

As the power drawn by the load increases the aforementioned operating point moves gradually along the output characteristic I(V) of the generator towards a point at the maximum power $P_{max}$ that can be supplied by the converter.

If the power drawn exceeds the maximum power $P_{max}$ the operating point previously situated in the current source area or in the voltage source area goes to the voltage source or the current source area as shown in FIGS. 1*f* and 1*g* beyond or short of the point with coordinates $I(P_{max})$, $V(P_{max})$. Under these conditions the operating point becomes unstable because there is a change of operating conditions, that is to say a change from the current or voltage source area to the other.

Because of its instability the operating point moves as far as the point on the output current-voltage characteristic I(V) characterized either by $I=0$ or $V=0$ and which corresponds to null power supplied by the solar generator. This is the phenomenon of "stalling", a stable state as shown in FIGS. 1*f* and 1*g*.

A system for extracting maximum power from a direct current generator with a substantially rectangular characteristic I(V) is described in French patent application No. 2 031 063. This system includes a loop controlling a transistor in the converter at variable frequency. It is not possible to obtain a regulated voltage with this system.

An object of the system in accordance with the invention for regulating the operating point of a direct current power supply is to remedy the aforementioned disadvantage by eliminating the stalling phenomenon.

Another object of the present invention is a regulation system for a direct current power supply in which the amplitude of excursion of the operating point about the maximum power point $P_{max}$ is variable.

Another object of the present invention is a regulation system for a direct current power supply in which when the power drawn is less than the maximum power $P_{max}$ the operating point may be varied either on the current source characteristic area or on the voltage source characteristic area.

A final object of the present invention is a regulation system for a direct current power supply in which a solar generator can be connected to the converter with no special precautions, one of the operating points corresponding to the power actually drawn being automatically achieved.

SUMMARY OF THE INVENTION

The present invention consists in a system for regulating the operating point of a direct current power supply comprising a current generator system and a pulse width modulation converter connected to said current generator system, said regulation system comprising:

means for sampling and measuring the current and voltage supplied by said current generator system to said converter and adapted to provide a signal representing said current and voltage, threshold detector means for sensing stalling of said converter connected to receive said signal representing said current and voltage supplied by said current generator system and adapted to provide a logic signal representing the stalled or non-stalled state of said converter relative to defined threshold values of said threshold detector means, and a loop for regulating the width of pulses supplied by said converter and comprising:

means for sampling and measuring the voltage supplied by said converter to a load, differential amplifier means connected to receive a first input said signal supplied by said means for measuring the voltage supplied by said converter and on a second input a reference signal and adapted to provide an amplified error signal, inverter means comprising an input connected to receive said amplified error signal and an inversion control input connected to receive said logic signal supplied by said threshold detector means and adapted to provide an inverted or non-inverted error signal, integrator means connected to receive said inverted or non-inverted error signal and adapted to provide an integrated error signal, and pulse width modulator means comprising a sawtooth signal generator and a comparator having a first input connected to receive from said integrator means said integrated error signal, a second input connected to receive the signal supplied by said sawtooth signal generator and an output adapted to provide a pulse width control signal to said pulse width modulation converter.

The regulating system in accordance with the invention finds applications in systems for supplying electrical power to artificial satellites, spacecraft and, more generally, any electrical power supply system using current generators such as solar batteries in aerospace or domestic applications.

The invention will be better understood from the following description given with reference to the appended drawings.

DESCRIPTION OF THE PREFERRED EMBODIMENTS

The system in accordance with the invention for regulating the operating point of a direct current power supply will first be described with reference to FIG. 2*a*.

Figure 1A:
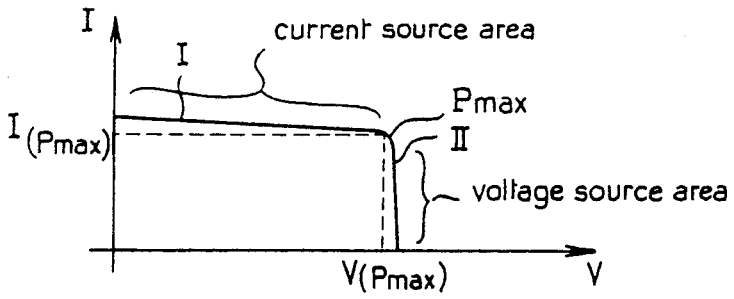
FIG 1a (PRIOR ART)
FIGS. 1*a* through 1*g* are diagrams relating to the operation of a prior art type generator as already described.
Figure 1B:
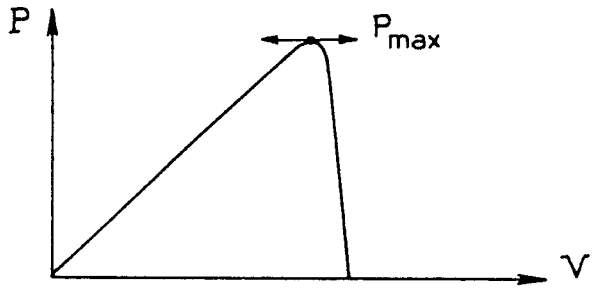
FIG 1b (PRIOR ART)
Figure 1C:
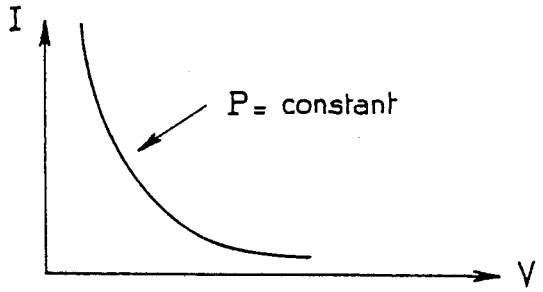
FIG 1c (PRIOR ART)
Figure 1D:
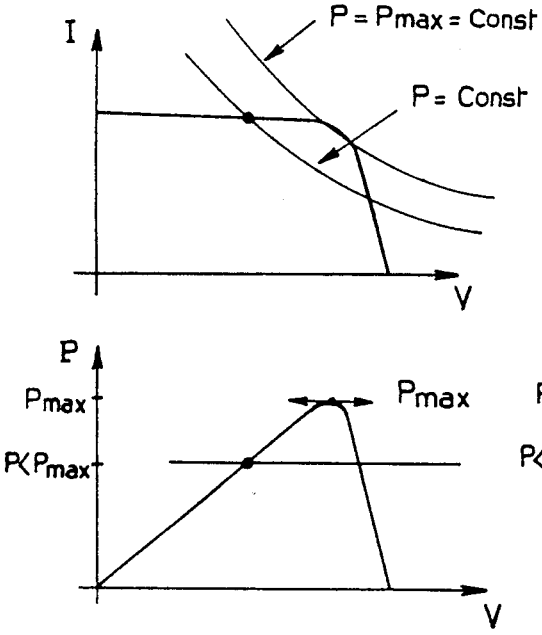
FIG 1d (PRIOR ART)
Figure 1E:
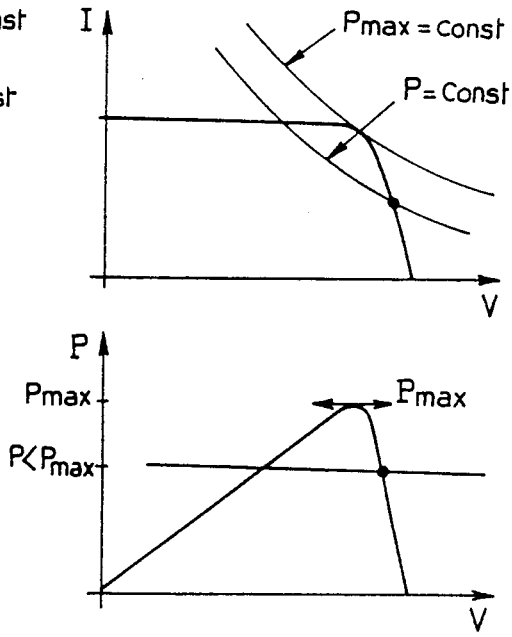
FIG 1e (PRIOR ART)

The direct current power supply comprises a current generator system 1 connected to a pulse width modulation converter 2. The current generator system 1 may comprise a system of solar cells and the term "current generator system" is to be understood as any system with a substantially rectangular output current-voltage characteristic as shown in FIG. 1*a*.

The pulse width modulation converter 2 is connected to the current generator system. It produces rectangular voltage pulses the width of which varies according to the power drawn by the useful load CU; the pulse width modulation converter naturally comprises smoothing circuits (not shown in FIG. 2*a*) which deliver the DC voltage Vc to the useful load CU.

Figure 2A:
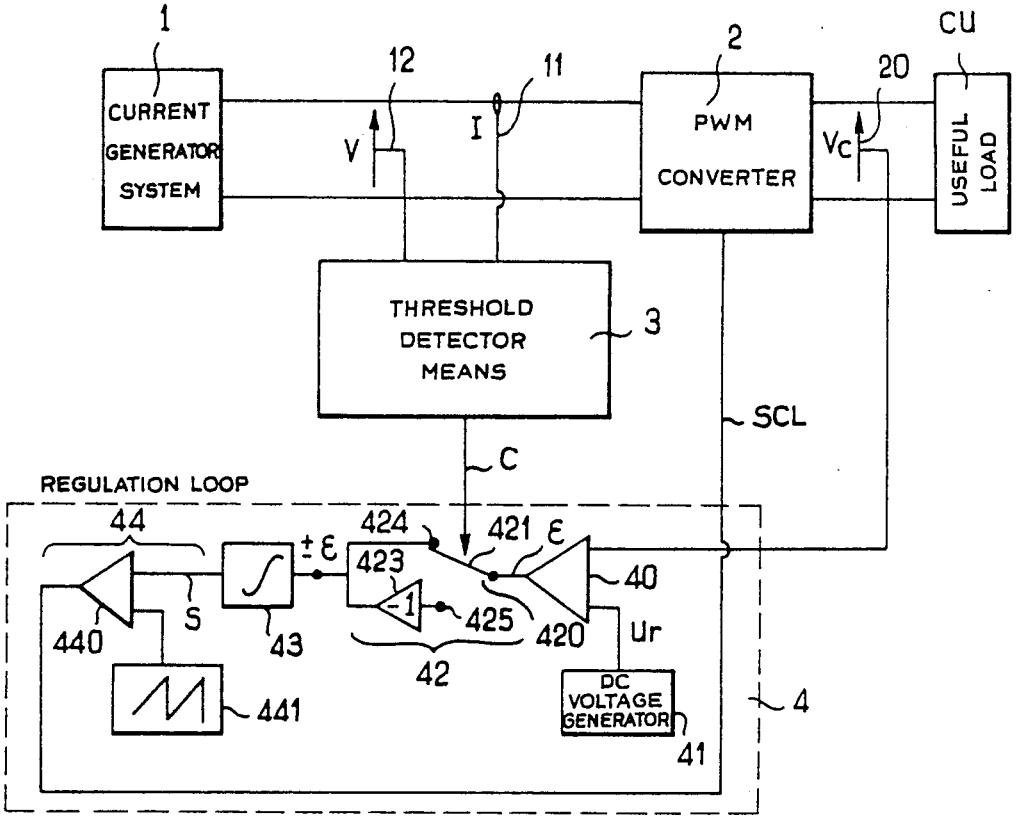
FIG. 2*a* shows a block schematic of the system for regulating the operating point of a direct current power supply comprising a current generator system connected to a pulse width modulation converter.

One particularly advantageous characteristic of the regulation system in accordance with the invention is that it comprises, as shown in FIG. 2*a*, means 11, 12 for sampling and measuring the voltage V and the current I delivered by the current generator 1 to the converter 2. The means for sampling and measuring the voltage V and the current I may advantageously comprise a potentiometer system for measuring the voltage V and a shunt or like device for sampling and measuring the current I. These conventional type components will not be described in detail as they are very well known to those skilled in the art. The sampling and measuring means 11 and 12 deliver respective signals I and V representing the current I and the voltage V at the output of the current generator and these are applied to the input of the pulse width modulation converter 2.

Figure 1F:
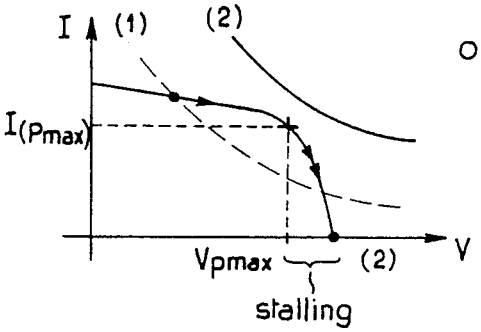
FIG 1f (PRIOR ART)
Figure 1G:
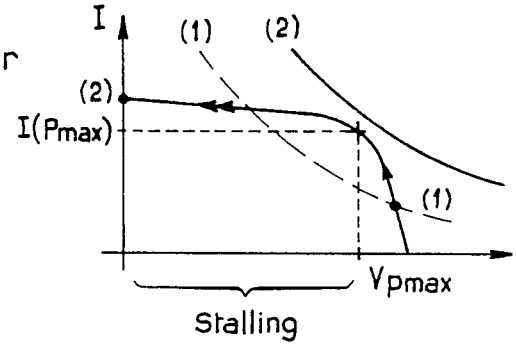
FIG 1g (PRIOR ART)

The regulation system in accordance with the invention further comprises threshold detector means 3 responsive to stalling of the converter 2. The stalled condition of the converter 2 is previously defined by corresponding values of the voltage V and the current I delivered by the current generator 1 to the converter 2 in relation to FIGS. 1*f* and 1*g*. The threshold detector means 3 responsive to stalling of the converter 2 receive the signals representing the current I and the voltage V supplied by the current generator 1 to the converter 2 and provide a logic signal C representing the stalled or non-stalled state of the converter 2 relative to the threshold values. It will be understood of course that the threshold values correspond either to an initially low value of the voltage V or an initially low value of the current I, comparison of the actual value of the voltage V and the actual value of the current I with the threshold values making it possible when the values of the voltage V or current I are less than the respective corresponding threshold values to indicate the stalled or non-stalled state of the converter 2 according to the power drawn by the useful load CU.

As shown in FIG. 2*a* the regulation system in accordance with the invention comprises a loop 4 for regulating the width of pulses supplied by the converter 2. A shown in FIG. 2*a* the regulation loop 4 comprises means 20 for sampling and measuring the voltage Vc supplied by the converter 2 to the useful load CU. These may comprise a potentiometer circuit similar to that already mentioned with reference to the means for sampling and measuring the voltage V supplied by the current generator I.

The regulation loop 4 also includes differential amplifier means 40 receiving on a first input the signal supplied by the means 20 for measuring the voltage supplied by the converter 2 and on a second input a reference voltage Ur. This reference voltage is supplied by a stabilized DC voltage generator 41. This type of generator will not be described as it well known to those skilled in the art. The differential amplifier means 40 supply an amplified error signal $\epsilon$.

Inverter means 42 include an input 420 connected to the output of the differential amplifier 40 and receiving the amplified error signal. The inverter means 42 also include an inversion control input symbolically represented by a switch member 421, the inversion control input 421 receiving the logic signal C supplied by the threshold detector means 3. The inverter means also include a direct output 424 for the amplified error signal and an inverting output 425 for the amplified error signal, the latter being connected to an inverter 423. Switched by the control signal C, the inverter means 42 supply either the non-inverted amplified error signal via the output 424 or the inverted amplified error signal via the output 425 and the inverter 423.

Integrator means 43 receive the inverted or non-inverted error signal ±E and provide an integrated error signal S.

Pulse width modulation means 44 are conventionally provided and include a comparator 440 and a sawtooth signal generator 441. The comparator has a first input receiving from the integrator 43 the integrated error signal S and a second input receiving the signals supplied by the sawtooth signal generator 441. The output of the comparator 44 supplies a pulse width control signal SCL to the pulse width modulation converter 2. The pulse width is controlled by the length of time for which the signal SCL is "high" which is in turn dependent on the time for which the sawtooth voltage supplied by the sawtooth signal generator 441 is less than the value of the inverted or non-inverted amplified error signal ±E.

Figure 2B:
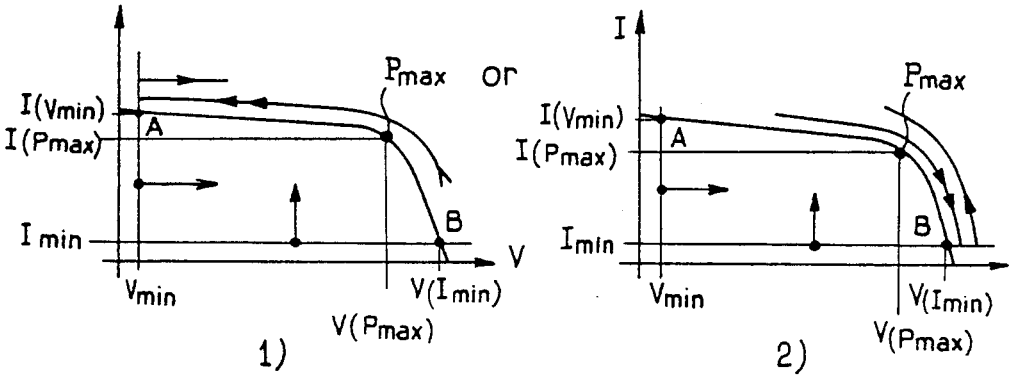
FIG. 2*b* shows at (1) and (2) the operating point of the system on the output current-voltage characteristic I(V) of the current generator at the first stalling.

In FIG. 2b diagrams (1) and (2) relate to respective current and voltage threshold values $I_{min}$ and $V_{min}$ for the threshold detector means 3 of the converter 2. Each time the converter 2 begins to stall, in other words each time the operating point of the regulator crosses the maximum power point $P_{max}$ on the output current-voltage characteristic I(V) of the voltage generator 1, the current I or voltage V parameter of the operating point goes below the threshold $I_{min}$ or $V_{min}$ the effect of which is to change the state of the inverter means 42. This changes the sign of the error signal E in the regulation loop 4 which causes the operating point of the converter 2 to move towards the maximum power point $P_{max}$ and so prevents indefinitely stalling of the converter 2.

If operating conditions are such that the power demand P is greater than the maximum power $P_{max}$ and continues to be so the operating point oscillates between two extreme positions on the output current-voltage characteristic I(V) of the current generator defined by the threshold values $I_{min}$ and $V_{min}$ and denoted A and B in FIG. 2b.

One particularly advantageous characteristic of the regulation system in accordance with the invention is that, in order to make it possible to extract an average power from the current generator 1 close to the maximum power $P_{max}$ that the latter is able to provide, the threshold detector means 3 of the converter 2 are of the variable threshold type. The thresholds $I_{min}$ and $V_{min}$ bracketing the maximum power point $P_{max}$ can therefore be varied towards the coordinates of that point.

To this end the variable threshold detector means 3 may operate as follows:

Starting from the operating point with coordinates $V_0 = V_{min}$, $I_0 = I(V_{min})$ where, employing the usual notation, $I(V_{min})$ represents the current supplied by the current generator 1 when the voltage V supplied by it is equal to $V_{min}$, this point naturally corresponds to the point A in FIG. 2b, diagram 1).

The next threshold point can be defined, for example, by the combination $(V_1, I_1)$, the current $I_1$ being defined by the equation $I_1 = k_I \cdot I_0$ and the value $V_1$ corresponding to the voltage value on the output current-voltage characteristic of the current generator 1. The successive threshold values can then be defined on the basis of the previous threshold value $(V_1, I_1)$, for example by the combinations $V_2 = k_V \cdot V_1$ and $I_2$ corresponding to the current value for the aforementioned voltage value $V_2$, or more generally by the following combinations:

$$\begin{cases} V_2 = K_V \times V_1 \\ I_2 \end{cases} \rightarrow \begin{cases} V_{2r} = k_V \times V_{2r-1} \\ I_{2r} \end{cases} \rightarrow \begin{cases} V_{2r+1} \\ I_{2r+1} = k_I \times I_{2r} \end{cases}$$

Of course, the coefficients $k_I$ and $k_V$ have values less than 1.

Starting from the operating point with coordinates $I_0 = I_{min}$, $V_0 = V(I_{min})$ where, employing the usual notation, $V(I_{min})$ represents the value of the voltage V on the output current-voltage characteristic I(V) of the current generator 1, this point corresponds substantially to the point B in FIG. 2b diagrams (1) and (2).

The first threshold value corresponding to the combinations $V_0$, $I_0$ may then be followed by a second threshold value corresponding to the value of the combination $V_1 = K_V \cdot V_0$ and $I_1$ corresponding to the current supplied by the current generator for the aforementioned voltage value $V_1$ and then by the second pair of values $V_2$ and $I_2 = k_I \cdot I_1$ where $V_2$ represents the value of the voltage on the output current-voltage characteristic of the current generator 1 for the aforementioned current $I_2$. Generally speaking, the successive threshold values corresponding to the pairs of values:

$$\begin{cases} V_2 \\ I_2 = k_I \times I_1 \end{cases} \rightarrow \begin{cases} V_{2r} \\ I_{2r} = k_I \times I_{2r-1} \end{cases} \rightarrow \begin{cases} V_{2r+1} = K_V \times V_{2r} \\ I_{2r+1} \end{cases}$$

$k_I$ and $k_V$ being defined as previously.

It can be shown that such variation in the threshold values $I_{min}$ and $V_{min}$ makes it possible to obtain convergence of the operating point towards the maximum power point $P_{max}$.

A more detailed description of the convergence of the operating point towards the maximum power point $P_{max}$ on the characteristic will now be given with reference to FIG. 2c.

If the power demand exceeds the maximum power $P_{max}$, as a result of successive operations of the switch K in the regulation loop on stallings initiated by crossing of the initial thresholds $I_{min}$ and $V_{min}$, the successive thresholds converge towards $I(P_{max})$ and $V(P_{max})$, respectively.

The converter extracts a power P which is less than $P_{max}$ but the power supplied P tends towards $P_{max}$. If the power demand P is greater than the maximum power $P_{max}$ the voltage delivered by the converter can only remain in the vicinity of the set point value if an auxiliary supply provides the additional power needed.

Figure 2C:
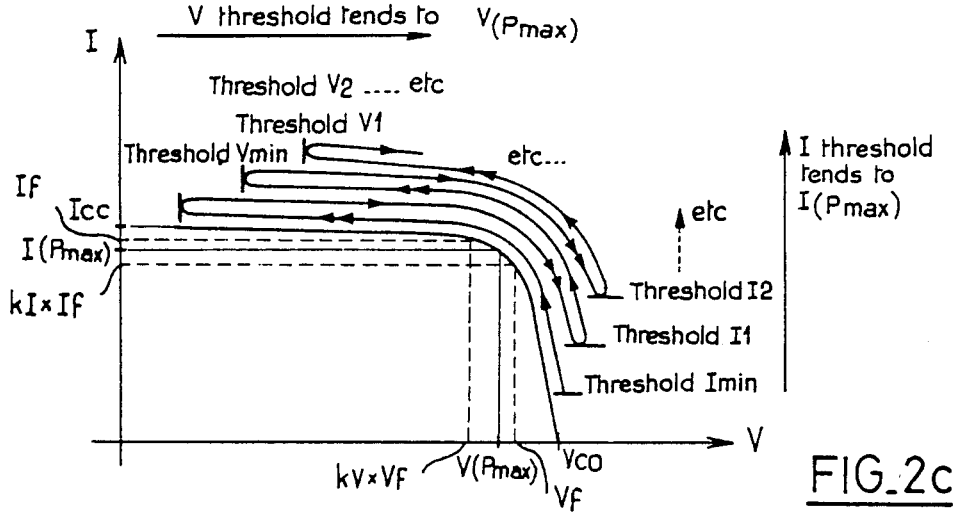
FIG. 2*c* shows a diagram explaining the functioning of the device shown in FIG. 2*a* in more detail in stages subsequent to those of FIG. 2*b* (1) or (2) where the power drawn is greater than $P_{max}$.

As shown in FIG. 2c, each time the threshold $I_{2r}$ is crossed the next voltage threshold is taken as the corresponding voltage $V(I_{2r}) \times k_V$ with $k_V < 1$. Similarly, each time the threshold $V_{2r}$ is crossed the next current threshold is taken as the corresponding current $I(V_{2r}) \times k_I$ with $k_I < 1$.

When this process stabilizes, the final threshold values are respectively:

current threshold: $k_I \times I_f$, and voltage threshold: $k_V \times V_f$, such that:

$V=f(k_I \times I_f)=V_f$ and $I=f^{-1}(k_V \times V_f)=I_f$.

If $k_I$ and $k_V$ tend towards unity, $k_I \times I_f$ tends to $I(P_{max})$ and $k_V \times V_f$ tends to $V(P_{max})$ but the convergence is slower.

An embodiment particularly suited to implementing the process as previously described will now be described with reference to FIG. 3*a*.

In this figure, the variable threshold detector means 3 of the converter 2 comprise, connected to the means 12 for sampling and measuring the voltage V, a first comparator circuit 31 in the form of a differential amplifier. The negative input of the comparator 31 is connected directly to the output of the means 12 for sampling and measuring the voltage V and the positive input of this comparator is connected to the output of the means 12 for sampling and measuring the voltage V through a first attenuator circuit 310 connected in series with a first sampling-blocking circuit 311. Of course, the first attenuator circuit 310 has an attenuation coefficient $k_V$ less than 1.

The threshold detector means 3 also include a second comparator circuit 32 in the form of a differential amplifier with its negative input connected directly to the output of the means 11 for sampling and measuring the current I and its positive input connected to the output of the means 11 for sampling and measuring the current I through a second attenuator circuit 320 connected in series with a second sampling-blocking circuit 321. The second attenuator circuit 320 has an attenuation coefficient $k_I$ less than 1.

Figure 3A:
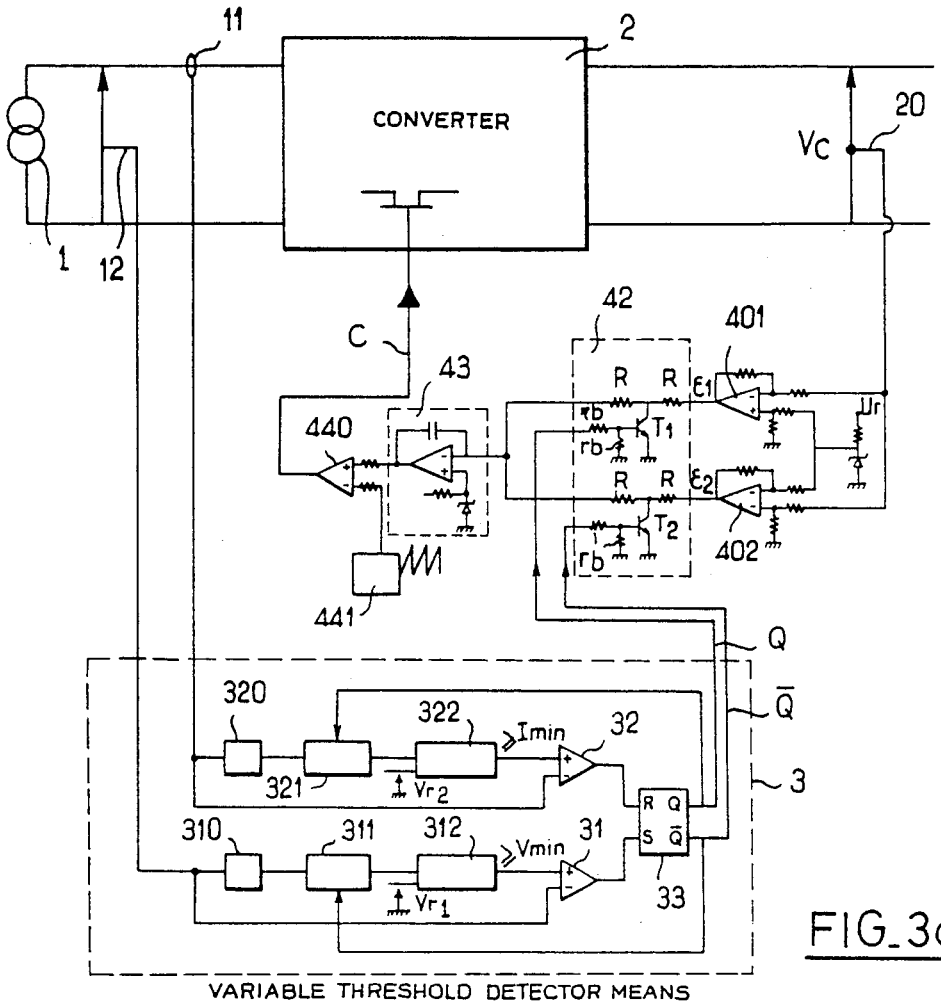
FIG. 3*a* shows one preferred embodiment of the regulation system in accordance with the invention as shown in FIG. 2*a*.

As also shown in FIG. 3*a* the variable detector threshold means 32 include an RS flip-flop 33 the R input of which is connected directly to the output of the second comparator 32 and the S input of which is connected directly to the output of the first comparator 31. The Q output of the RS flip-flop 33 supplies the logic signal C representing the stalled or non-stalled state of the converter 2 relative to the aforementioned variable threshold values. The $\overline{Q}$ output of the RS flip-flop 33 is connected directly to the sampling-blocking control input of the first sampling-blocking circuit 311 and the Q output is connected to the sampling-blocking control input of the second sampling-blocking circuit 321. The sampling-blocking circuits 321 and 311 store alternately a fraction $k_I$ of the current I supplied by the current generator 1 when the latest voltage threshold $V_r$ is crossed and a fraction $k_V$ of the voltage V supplied by the current generator 1 to the converter 2 when the latest current threshold $I_r$ is crossed. The threshold crossings memorized in this way correspond to variable values in accordance with the previously described law of variation and are detected by the comparators 31 and 32 which then trigger the RS flip-flop 33 which supplies the logic signal C causing the sign of the amplified error signal to be changed. The variable threshold detector means 3 also include a conditional switching circuit 312, 322 connected to the outputs of the sampling-blocking circuits 311 and 321 and to the positive inputs of the first and second comparators 31 and 32. The conditional switching circuit 312, 322 receives on a first input the signal supplied by the corresponding sampling-blocking circuit 311 or 321 and on a second input a reference voltage $V_{r1}$ or $V_{r2}$ representing the respective limiting threshold value $V_{min}$ or $I_{min}$. Each conditional switching circuit 312, 322 passes either the signal supplied by the corresponding sampling-blocking circuit or the reference voltage $V_{r1}$ or $V_{r2}$, whichever is the greater.

If the power drawn by the useful load is increasing and greater than $P_{max}$ the latest sampled threshold values vary accordingly and the limiting threshold values for the voltage V and the current I supplied by the current generator 1 converge towards the corresponding current and voltage values at the maximum power point $P_{max}$ denoted $I(P_{max})$ and $V(P_{max})$ as shown in FIG. 2*c*.

If the power P drawn by the useful load CU falls below the maximum power $P_{max}$ that the current generator 1 can supply the converter 2 goes with equal probability to one or other of the possible operating points denoted $A_i$ and $B_i$ in FIG. 3*b*.

A practical embodiment enabling initialization of the threshold values $V_{min}$ and $I_{min}$ and imposing an operating point such as the point $A_i$ shown in FIG. 3*b* will now be described with reference to FIGS. 4*a* and 4*b*.

Figure 4A:
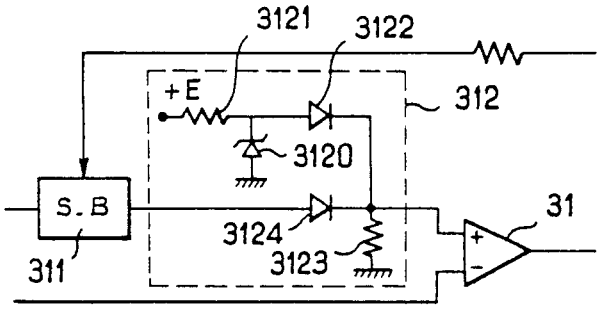
FIGS. 4*a* and 4*b* show one specific and non-limiting preferred embodiment of the system in accordance with the invention as shown in FIG. 3*a*.

In FIG. 4*a*, in which the reference numbers correspond to the conditional switching circuit 312, although this example is not limiting, the circuit includes a zener diode 3120 supplying the reference voltage $V_{r1}$ representing the respective limiting threshold value $V_{min}$ or $I_{min}$. The zener diode 3120 is connected to a voltage supply +E by a resistor 3121 and to a first diode 3122 biased in the forward direction relative to the supply +E. The diode 3122 is connected to the positive input of the comparator 31 which is loaded by a resistor 3123 connected in parallel with this input of the comparator 31. A second diode 3124 connects the output of the sampling-blocking circuit 311 to the positive input of the comparator 31. The two diodes 3122 and 3124 in combination with the resistance 3123 constitute an analog OR gate passing the input signal with the higher amplitude.

Figure 3B:
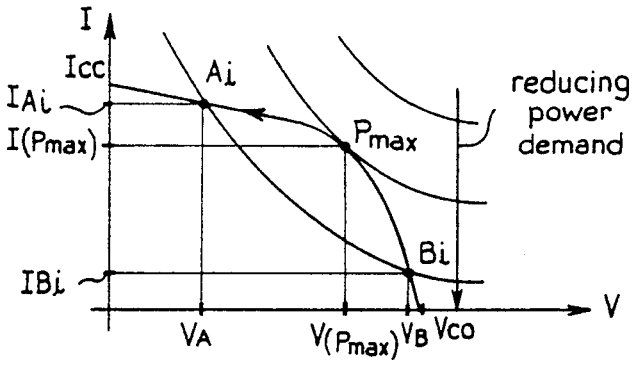
FIG. 3*b* shows a diagram showing the operating point of the system on the output current-voltage characteristic I(V) of the current generator when the power drawn falls below $P_{max}$.

Because of electrical loads imposed on the components of the power supply system and the regulation system in accordance with the invention, it may be desirable to impose one of the two operating points $A_i$ or $B_i$ as shown in FIG. 3*b*.

The point $B_i$ will be chosen if it is required to limit the current drawn by the converter 2 to a current $I_L$ such that $I_{Ai}>I_L>I_{Bi}$.

The point $A_i$ will be chosen if is required to limit the input voltage of the converter 2 to a voltage $V_L$ such that $V_{Bi}>V_L>V_{Ai}$.

To limit the electrical load imposed on the components it may be necessary to impose the operating point if the I(V) characteristic of the generator 1 (a solar generator, for example) varies strongly. Such variations occur, for example, in situations such as a space probe approaching the sun, when the operating point is immediately positioned on the current source part with the converter input current limited to $I_{min}$.

Figure 4B:
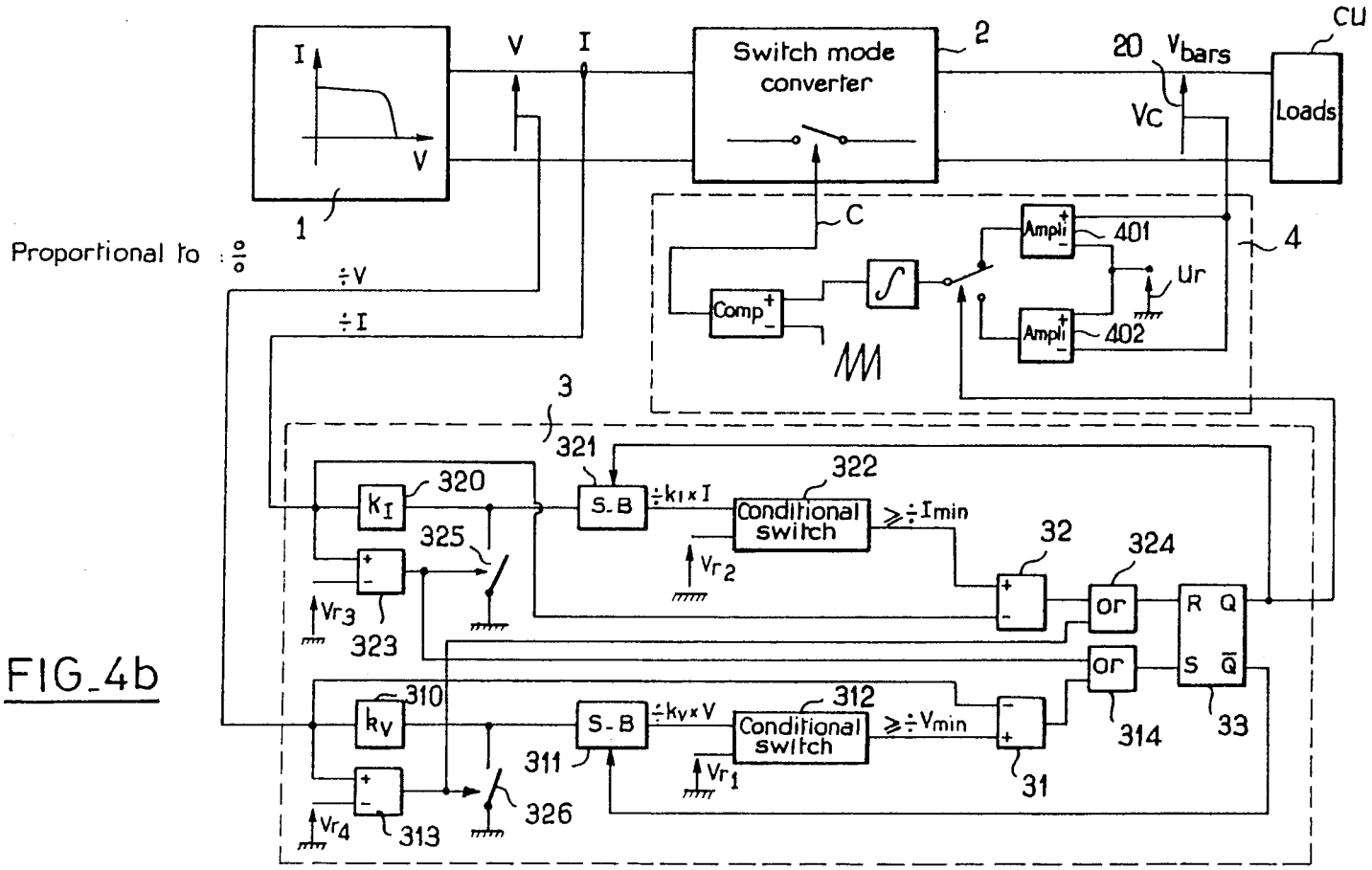
Figure 4C:
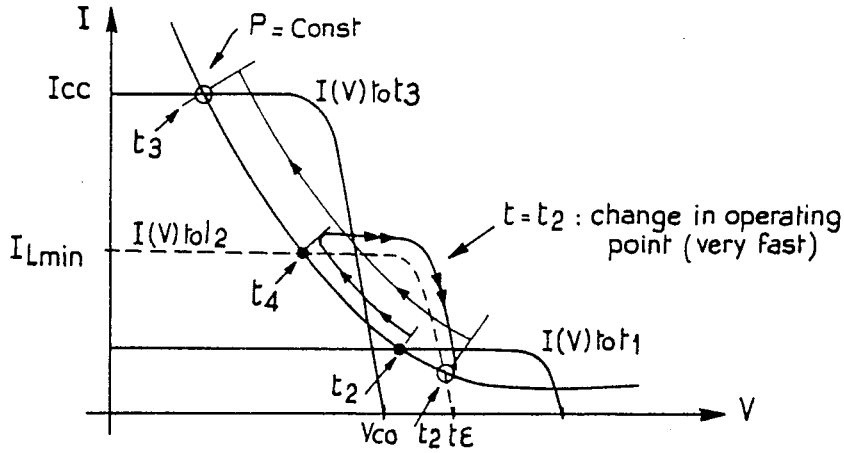
FIGS. 4*c* through 4*e* show diagrams explaining the functioning of the device in accordance with the invention as shown in FIG. 4*b*.

As shown in FIG. 4*c* the operating point can be situated in the "current source" area if it is required to limit the input voltage of the converter to a value $V_{lim}$ or in the "voltage source" area if it is required to limit the input current of the inverter to a value $I_{lim}$.

In order to make the operating point situated in the "current source" area move to the "voltage source" area and to prevent the input current of the converter exceeding $I_{lim}$, as shown in FIG. 4*b* the variable threshold detector means 3 also include a comparator 323 the positive input of which is connected to the means for sampling and measuring the current $I_1$ and the negative input of which is connected to receive a reference voltage $V_{r3}$ representing the limiting current $I_{lim}$. The output of the comparator 323 which is connected to the S input of the RS flip-flop 33 by an OR gate 314 receiving on a second input the signal supplied at the output of the comparator 31 supplies, when crossing of the threshold is detected, a control signal for inserting a corresponding inversion into the regulation loop 4 to render the initial operating point unstable. To avoid the current threshold of the stalling detector preventing the operating point reaching the "voltage source" area, a switch 325 controlled by the output of the comparator 323 simultaneously bypasses the sampling and blocking circuit 321 so that a null value can be input to the sampling and blocking circuit 321, given that the current threshold can only be reinitialized to the value $I_{min}$, if this has not been done already.

In order to make the operating point situated in the "voltage source" area move to the "current source" area to prevent the converter input voltage exceeding $V_{lim}$, the variable threshold detector means 3 also include another comparator 313 the positive input of which is connected to the voltage sampling and measuring means and the negative input of which is connected to receive a reference voltage $V_{r4}$ representing the limiting voltage $V_{lim}$. When crossing of the threshold is detected the output of the comparator 313 which is connected to the R input of the RS flip-flop 33 through an OR gate 324 receiving on a second input the signal at the output of the comparator 32 supplies a control signal for introducing a corresponding inversion into the regulation loop 4. To avoid the voltage threshold of the stalling detector preventing the operating point reaching the "current source" area a switch 326 controlled by the output of the comparator 313 simultaneously bypasses the sampling and blocking circuit 312 so that a null value can be input to the sampling and blocking circuit 312, given that the voltage threshold can only be reinitialized to the value $V_{min}$, if this has not been done already.

Figure 4D:
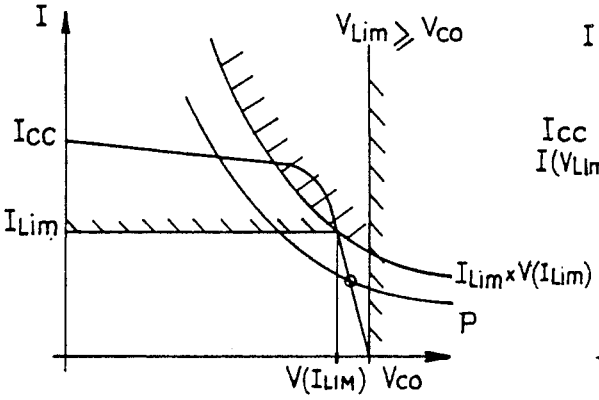
Figure 4E:
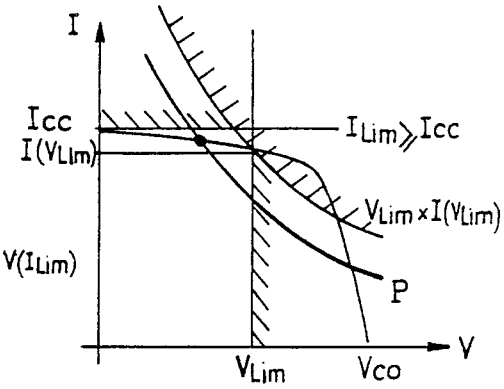

Of course, simultaneous use of the circuits for limiting the current and the voltage to the values $I_{lim}$ and $V_{lim}$ is possible provided that the I(V) characteristic of the generator 1 (a solar generator on a satellite, for example) is such that:

$$V_{lim} \geqq VCO \quad \text{OR} \quad I_{lim} \geqq ICC$$
$$\text{AND} \qquad\qquad \text{AND}$$
$$P \leqq I_{lim} \times V(I_{lim}) \qquad P \leqq V_{lim} \times I(V_{lim})$$

as shown in FIGS. 4*d* and 4*e*.

One particularly advantageous embodiment of the differential amplifier means 40 and the inverter means 42 previously described with reference to FIG. 2*a* will now be described with reference to the previously mentioned FIG. 3*a*.

In FIG. 3*a* the differential amplifier means 40 and the inverter means 42 comprise a first error amplifier 401 the positive input of which is connected to receive the reference voltage Ur supplied by the reference voltage supply 41 (not shown in FIG. 3*a*). The negative input of the first amplifier 401 is connected to the means 20 for sampling and measuring the voltage Vc supplied by the converter 2. The output of the first error amplifier 401 supplies a first error signal $\epsilon 1$.

The negative input of a second error amplifier 402 is connected to receive the reference voltage Ur and the positive input is connected to the means 20 for sampling and measuring the voltage Vc supplied by the converter 2. The output of the second error amplifier 402 supplies a second error signal $\epsilon 2$. The gain of the second error amplifier 402 is identical to the gain of the first error amplifier 401. Given these arrangements, the second error amplifier 402 supplies an error signal $\epsilon 2$ such that $\epsilon 2 = -\epsilon 1$. The output of the first error amplifier 401 and the output of the second error amplifier 402 are connected to a common point which is connected to the input of the integrator 43. This connection is made through load resistors R and switching transistors T1, T2 in a common emitter circuit with their respective bases connected to the Q and Q outputs of the RS flip-flop 33. The transistors T1 and T2 are biased by respective resistors rb. The transistors T1, T2 therefore constitute the switch K. The aforementioned opening (and reciprocally closing) switching therefore enables the common point of the transistor T1 or respectively T2 to supply an amplified error signal $\epsilon 1$ or $\epsilon 2$ with $\epsilon = \epsilon 1$ or $\epsilon = -\epsilon 1$. The aforementioned embodiment therefore makes it possible to obtain at the output an inverted or non-inverted amplified error signal $\pm\epsilon$.

The embodiment previously described is fully satisfactory. However, on passing from the maximum power extraction from the generator mode to the output voltage regulation mode the generator operating point can go randomly into the voltage source area or the current source area, because of the symmetry of the system.

It may be desirable on going from the maximum power extraction from the generator mode to the voltage or current regulation mode for the operating point to go systematically and immediately to the voltage source area or the current source area without waiting for the operating point to reach its limiting value $I_{lim}$ or $U_{lim}$, as previously described.

In one embodiment of the invention this can be achieved by providing inverter means including an inverter having a first input receiving the amplified error signal, a second input, an output and an inversion control input receiving the logic signal representing the stalled or non-stalled state of the converter, reference voltage generator means being connected directly to the second output of the inverter the output of which is connected directly to the input of the integrator means so as to supply to the latter either the amplified error signal or (in response to switching by means of the logic signal representing the stalled state of the converter) the reference voltage so that the operating point is positioned directly in the current source area or voltage source area independently of the value of the input current or of the converter voltage.

The aforementioned embodiment will first be described with reference to FIG. 5.

Figure 5:
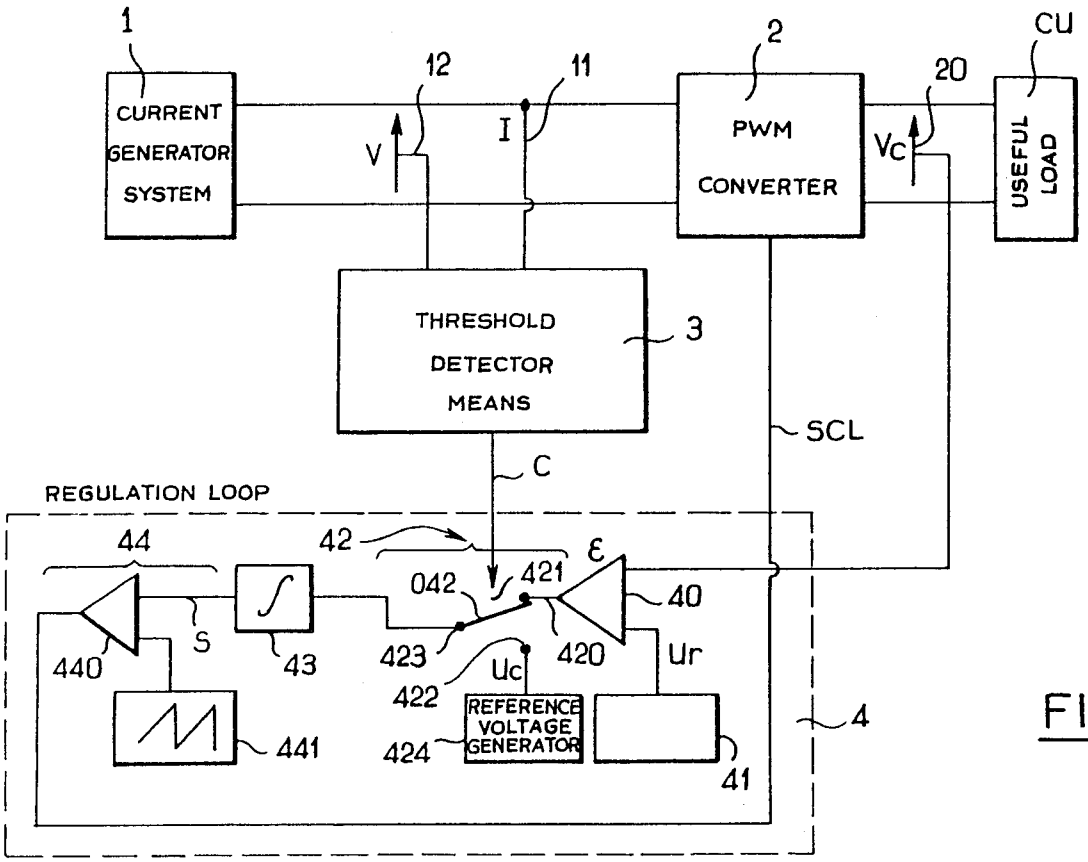
FIG. 5 shows a functional block schematic of a variant embodiment of the invention for systematic and immediate passage of the operating point to the voltage source area or to the current source area on changing from maximum power extraction mode to voltage regulation mode.

Referring to FIG. 5, the regulation system in accordance with the invention comprises as previously described a current generator system 1 connected to a pulse width modulation converter 2.

Means 11 and 12 for sampling and measuring the voltage V and the current I supplied by the current generator 1 to the converter 2 deliver a signal representing the aforementioned current and voltage. Threshold detector means 3 responsive to stalling of the converter 2 receive the signal representing the current I and the voltage V and supply a logic signal C representing the stalled or non-stalled state of the converter 2 relative to the threshold values.

A regulation loop 4 regulates the width of the pulses delivered by the converter. This loop includes means 20 for sampling and measuring the voltage Vc supplied by the converter 2 to the load CU and differential amplifier means 40 receiving on a first input the signal supplied by the means 20 for measuring the voltage supplied by the converter and on a second input a reference voltage UR and supplying on its output the amplified error signal $\epsilon$.

Inverter means 42 comprise an inverter 042 having a first input 420 receiving the amplified error signal $\epsilon$, a second input 422, an output 423 and an inversion control input 421 receiving the aforementioned logic signal C.

A generator 424 producing the reference voltage Uc is connected directly to the second input 422 of the inverter 042. The output 4230 of the inverter 042 is connected directly to the input of the integrator means 43 to supply to the latter either the amplified error signal $\epsilon$ or (in response to switching due to the logic signal C representing the stalled or non-stalled state of the converter 2) the reference voltage Uc in order to position the operating point directly in the current source area or the voltage source area independently of the value of the input current or of the input voltage of the converter 2.

The integrator means 43 and the pulse width modulation means constituted by the comparator 440 and the sawtooth signal generator 441 in FIG. 5 have the same function as the same components of the other embodiments.

The embodiment of the invention shown by way of non-limiting example in FIG. 5 therefore makes it possible to substitute for the amplified error signal $\epsilon$ securing operation in voltage regulation mode in the current source area or in the voltage source area a constant control voltage in the form of the reference voltage Uc which is similar to that supplied by the inverted outut of the error amplifier 40 when the converter is operating in maximum power extraction mode. Given these conditions, it is readily seen that by virtue of the constant voltage Uc integrated by the integrator 43 the operating point of the converter is always returned to the corresponding operating point in the voltage source area or in the current source area even if at this time the power demand of the useful load CU is less than the maximum power that the generator can supply. The operating point of the converter 2 is therefore positioned in the current source area or in the voltage source area independently of the value of the input current or the voltage of the converter.

Generally speaking, the reference voltage Uc can be provided by a highly stable DC voltage supply. This voltage has a value substantially equal to that of the amplified error signal $\epsilon$ that it replaces for the operating point corresponding to maximum power extraction so as to impose, on reduction of the power demand, a position of the operating point of the converter and of the generator 1 either in the current source area or in the voltage source area.

Figure 6:
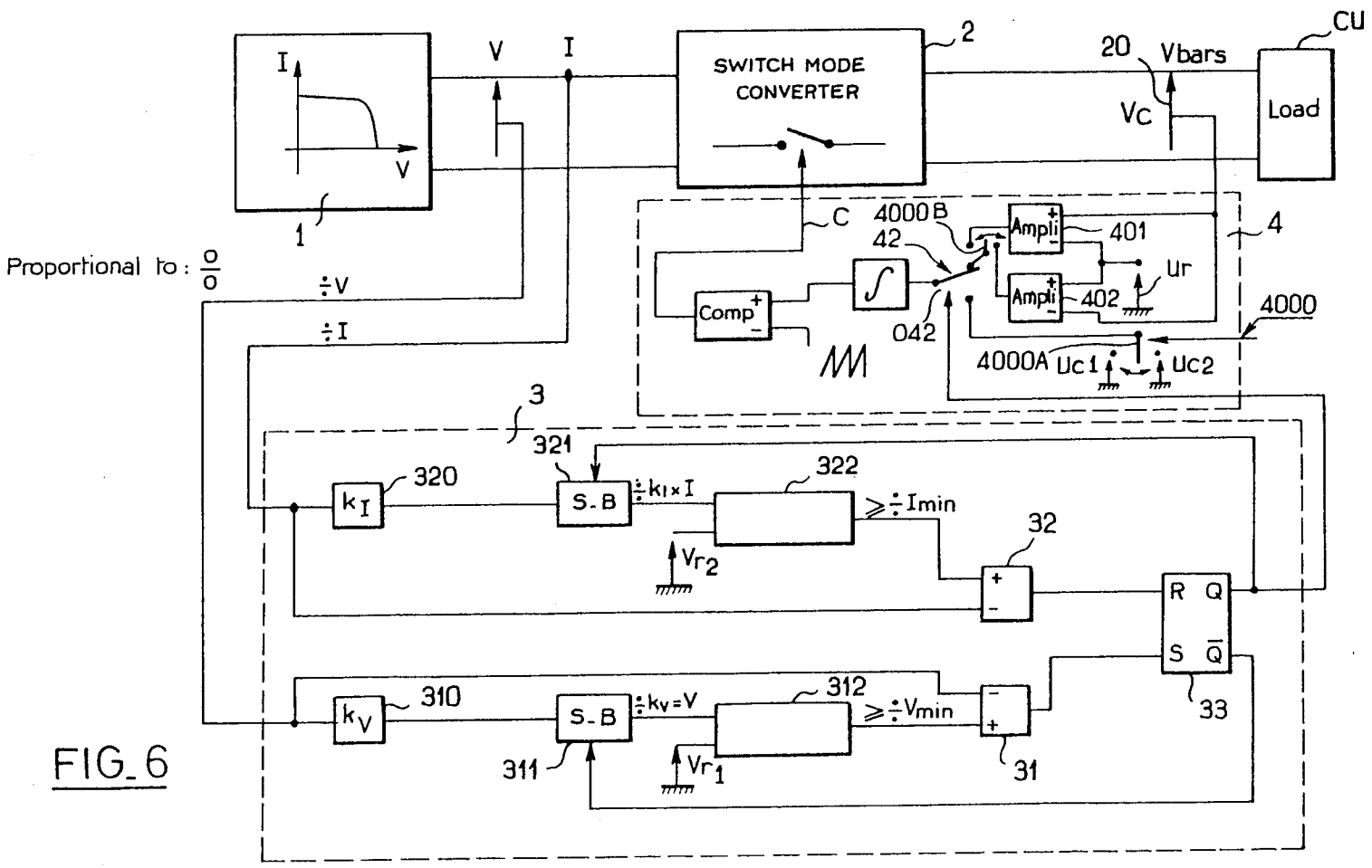
FIG. 6 shows in more detail one embodiment of the invention.

FIG. 6 shows one specific embodiment corresponding substantially to that of the previously described FIG. *3a*.

In this embodiment the control voltage Uc can correspond to one of two values Uc1 and Uc2 near the control voltage Uc. In this case the two values Uc1 and Uc2 may correspond to choice of operation of the generator 1 in the voltage source area or in the current source area depending on the chracteristics of the generator and those of the switch mode converter 2. A switch 4000 enables the user to choose between the corresponding control voltages Uc1 and Uc2, the value of the voltage Uc1 being the value of the voltage for operation in maximum power extraction mode for the amplifier 402, similar to the amplifier 401 but of opposite polarity, the voltage Uc2 having the corresponding value for the amplifier 401, the latter being switched out and replaced by the aforementioned amplifier 402. The switch 4000 may be in two parts 4000A, 4000B constituting a two-pole switch, the second part 4000B having first and second inputs respectively connected to the outputs of the amplifiers 401 and 402. The output of the second part 4000B is connected to the first input if the inverter 042. Simultaneous switching of the two parts 4000A and 4000B of the switch 4000 makes it possible to substitute for the output voltage from the amplifier 401 or 402 the control voltage Uc2 or Uc1.

In practice these two voltages are very similar and the embodiment shown in FIG. 6 is given by way of non-limiting example only. In FIG. 6 components carrying the same reference numbers as components of other, previously described embodiments, in particular those of FIG. *3a*, naturally have the same functions.

A simplified embodiment of a regulation system in accordance with the present invention will now be described with reference to FIG. 7.

Figure 7:
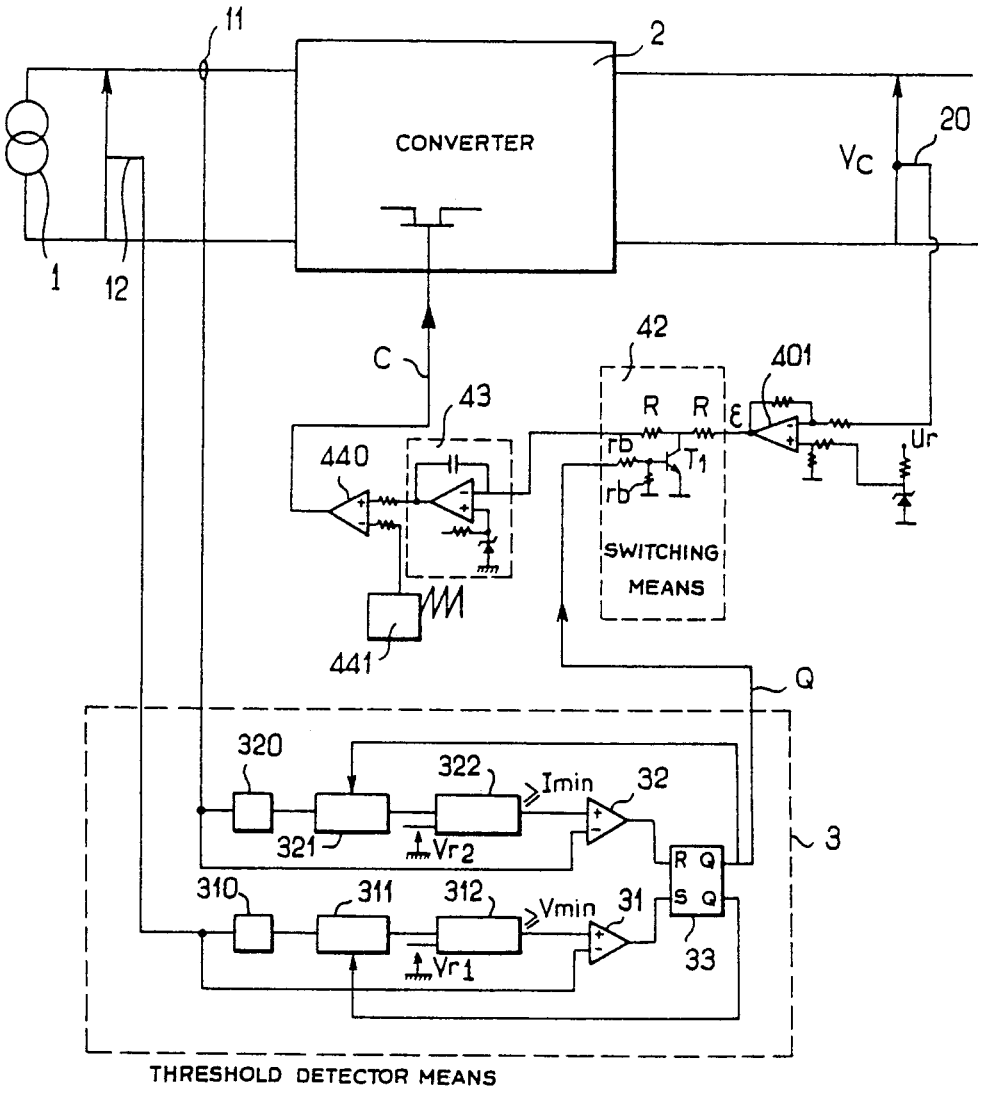
FIG. 7 shows in a simplified way the embodiment of the invention previously shown in FIG. 5.

The embodiment shown in FIG. 7 is a simplified version of that shown in FIG. 6. The amplified error signal $\epsilon$ is supplied by an amplifier 401 constituting a comparator with a reference voltage Ur. The comparator 401 is following by a switching stage 42 which has the same function as the inverter means 42 previously described. The switching stage 42 is connected to the output of the amplifier 401 and comprises a transistor T1 in a common emitter circuit the base of which is connected directly to the Q output of the fip-flop 33 of the threshold detector means 3 of the converter 2.

In the embodiment shown in FIG. 7 the reference voltage Uc is generated when the Q output of the flip-flop 33 goes "high" by turning on transistor T1. This makes it possible to apply to the input of the integrator means 43 a substantially null reference voltage Uc, neglecting the saturation voltage $VCE_{sat}$ of transistor T1, comparable with the error voltage of the amplifier replaced in maximum power extraction mode.

This completes the description of a particularly high performance system for regulating the operating point of a direct current power supply which comprises a current generator system connected to a pulse with modulation converter.

The regulation system in accordance with the invention appears particularly well suited to use in space to supply electrical power to electronic circuitry of artificial satellites or spacecraft, especially space probes. In such applications, given the virtual impossibility of repairing any failure and limited knowledge of how the behavior of the solar generator (the current generator 1) is changing, this regulation system makes it possible to guard against malfunctions due to particularly unfavorable operating conditions such as, for example, various forms of deterioration, shadowing, pointing away from the sun, distance from the sun, variations in temperature and the like. Of course, the configuration of the power supply proper is not limiting in any way. A buffer storage system comprising a battery optionally in series with a discharge regulator can be connected in parallel with the useful load CU at the output of the converter. The functioning of the regulation system in accordance with the invention is not altered in any way by the presence of a buffer storage system of this kind.

The system in accordance with the invention for regulating the operating point of a direct current power supply makes it possible to achieve satisfactory operation even without modifying the current-voltage chracteristic of a solar generator to allow for ageing and/or the environmental conditions of the electronic components constituting it.

There is claimed:

1. System for regulating the operating point of a direct current power supply comprising a current generator system and a pulse width modulation converter connected to said current generator system, said regulation system comprising:

means for sampling and measuring the current and voltage supplied by said current generator system to said converter and adapted to provide a signal representing said current and voltage, threshold detector means for sensing stalling of said converter connected to receive said signal representing said current and voltage supplied by said current generator system and adapted to provide a logic signal representing the stalled or non-stalled state of said converter relative to defined threshold values of said threshold detector means, and a loop for regulating the width of pulses supplied by said converter and comprising:

means for sampling and measuring the voltage supplied by said converter to a load, differential amplifier means connected to receive on a first input said signal supplied by said means for measuring the voltage supplied by said converter and on a second input a first reference signal and adapted to provide an amplified error signal, inverter means comprising an input connected to receive said amplified error signal and an inversion control input connected to receive said logic signal supplied by said threshold detector means and adapted to provide an inverted or non-inverted error signal, integrator means connected to receive said inverted or non-inverted error signal and adapted to provide an integrated error signal, and pulse width modulator means comprising a sawtooth signal generator and a first comparator having a first input connected to receive from said integrator means said integrated error signal, a second input connected to receive the signal supplied by said sawtooth signal generator and an output adapted to provide a pulse width control signal to said pulse width modulation converter.

2. System according to claim 1 wherein said threshold detector means is a variable threshold detector means.

3. System according to claim 2 wherein said variable threshold detector means comprises, connected to said means for sampling and measuring said voltage and said current supplied by said current generator to said converter to receive said signal representing said voltage and said current supplied by said current generator to said converter:

a first attenuator circuit, a first sampling and blocking circuit in series with said first attenuator circuit and a first comparator circuit comprising a differential amplifier having a negative input connected directly to said voltage sampling and measuring means and a positive input connected to said voltage sampling and measuring means through said first attenuator circuit and said first sampling and blocking circuit, a second attenuator circuit, a second sampling and blocking circuit in series with second attenuator circuit and a second comparator circuit comprising a differential amplifier having a negative input connected directly to said current sampling and measuring means and a positive input connected to said current sampling and measuring means through said second attenuator circuit and said second sampling and blocking circuit, an RS flip-flop having an R input connected to said second comparator circuit, an S input connected to said first comparator circuit and a direct or complemented output adapted to provide said logic signal representing the stalled or non-stalled state of said converter with respect to said threshold values, said first and second sampling and blocking circuits having respective control inputs to which said direct or complemented output of said RS flip-flop is connected.

4. System according to claim 3 further comprising a respective conditional switching circuit for each voltage and current reference value representing a minimum threshold value and wherein said first and second sampling and blocking circuits are connected to the inputs of the respective comparator circuits by the respective conditional switching circuits.

5. System according to claim 4 wherein each conditional switching circuit comprises:

a zener diode for supplying a reference voltage representing the voltage or current reference value, a resistor is connected to a supply voltage and a first diode is biased in the forward direction relative to said supply voltage and connected to the positive input of the respective comparator circuit, a second diode connecting the output of the respective sampling and blocking circuit to the positive input of the respective comparator circuit, said first and second diodes and said resistor constituting an analog OR gate means for passing the input signal with the higher amplitude.

6. System according to claim 5 wherein, in order to situate the operating point of said converter at one of the points where the current-voltage characteristic of the generator intersects the curve for constant power consumption at less than the maximum power and in order to make the operating point situated in the "current source" area move to the "voltage source" area and to limit the input current of the converter to a value less than a defined current limiting value, the system comprises:

a third comparator circuit having a positive input connected to said current sampling and measurement means and a negative input connected to receive a reference voltage representing said current limiting value, and a first OR gate having a first input connected to receive a signal supplied by the first comparator circuit and a second input connected to receive a signal delivered by said third comparator circuit whereby a corresponding inversion can be inserted into said regulation loop to render an initial operating point unstable.

7. System according to claim 5 wherein, in order to make the operating point situated in the "voltage source" area move to the "current source" area and to limit the input voltage of the converter to a value less than a defined voltage limiting value, the system comprises:

a fourth comparator circuit having a positive input connected to said voltage sampling and measurement means and a negative input connected to receive a reference voltage representing said voltage limiting value, and a second OR gate having a first input connected to receive a signal supplied by the second comparator circuit and a second input connected to receive a signal delivered by said fourth comparator circuit whereby a corresponding inversion can be inserted into said regulation loop to render an initial operating point unstable.

8. System according to claim 6 wherein, in order to make the operating point situated in the "voltage source" area move to the "current source" area and to limit the input voltage of the converter to a value less than a defined voltage limiting value, the system comprises:

a fourth comparator circuit having a positive input connected to said voltage sampling and measurement means and a negative input connected to receive a reference voltage representing said voltage limiting value, and a second OR gate having a first input connected to receive a signal supplied by the second comparator circuit and a second input connected to receive a signal delivered by said fourth comparator circuit whereby a corresponding inversion can be inserted into said regulation loop to render an initial operating point unstable.

9. System according to claim 8 further comprising a first and second switch connected in parallel with the input of each sampling and blocking circuit and adapted to be controlled by the output of said third and fourth comparator circuits, respectively, so that a null value may be input to each respective sampling and blocking circuit, whereby the current or voltage threshold can only be reinitialized to a respective minimum value.

10. System according to claim 7 further comprising a second switch connected in parallel with the input of the first sampling and blocking circuit and adapted to be controlled by the output of said fourth comparator circuit so that a null value may be input to the first sampling and blocking circuit, whereby the voltage threshold can only be reinitialized to a minimum value.

11. System according to claim 3 wherein said differential amplifier means and said inverter means comprise a first error amplifier having a positive input connected to receive said first reference voltage, a negative input connected to said means for sampling and measuring the voltage supplied by said converter and an output adapted to provide a first error signal, a second error amplifier having a negative input connected to receive said reference first voltage, a positive input connected to said means for sampling and measuring the voltage supplied by said converter, an output adapted to provide a second error signal which is of the same magnitude but the opposite sign to said first error signal, a common point connected to the respective outputs of said first and second error amplifiers and to the input of said integrator, through a resistor and first and second switching transistors in a common emitter circuit with the respective base connected to the direct or complemented output of said RS flip-flop, said resistor and first and second switching transistors providing the aforementioned connection between said common point and the respective error amplifier outputs, whereby said first and second switching transistors may be switched on and off to supply an amplified error signal with either polarity.

12. System according to claim 1 wherein said inverter means comprises an inverter circuit having a first input connected to receive said amplified error signal, a second input, an output and an inversion control input connected to receive said logic signal, and means for generating a second reference voltage connected to said second input of said inverter circuit the output of which is connected to the input of said integrator means to supply thereto one of said amplified error signal and, in response to switching caused by said logic signal representing said stalled state of said converter and said second reference voltage, so as to position the operating point directly in one of said current source area and said voltage source area independently of the value of one of the current and the voltage supplied by said current generator system.

13. System according to claim 12 wherein said first reference voltage has a value substantially equal to the value of said amplified error signal for the operating point corresponding to maximum power extraction so that if the power demand is reduced, the operating point is placed in one of said current source area and said voltage source area.

14. System according to claim 13 further comprising an amplifier adapted to supply said amplified error signal and function as a second comparator with reference to said first reference voltage and a switching stage connected to the output of said amplifier and comprising a common emitter transistor having a base connected to the direct output of said flip-flop, whereby said second reference voltage is generated when said direct output of said flip-flop goes "high" as a result of saturation of said transistor so as to apply to the input of said integrator means a substantially null reference voltage, neglecting the saturation voltage of said transistor.

* * * * *